US007646302B2

(12) United States Patent
Setty

(10) Patent No.: US 7,646,302 B2
(45) Date of Patent: Jan. 12, 2010

(54) SCOOPING DEVICE FOR CONTAINER HAVING AN ELECTROMAGNETIC SURVEILLANCE DEVICE

(75) Inventor: Thomas J. Setty, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 352 days.

(21) Appl. No.: 11/332,435

(22) Filed: Jan. 13, 2006

(65) Prior Publication Data

US 2007/0164869 A1 Jul. 19, 2007

(51) Int. Cl.
*G08B 13/14* (2006.01)

(52) U.S. Cl. ..... 340/572.1; 340/572.4; 340/572.8; 340/568.1; 340/551; 340/571; 340/825.25; 235/375; 235/382; 235/492

(58) Field of Classification Search ..... 340/572.1, 340/572.4, 572.8, 568.1, 551, 571, 825.35; 229/401, 402, 404; 426/110, 115; 235/375, 235/382, 492
See application file for complete search history.

(56) References Cited

U.S. PATENT DOCUMENTS 4,001,444 A * 1/1977 Clarke ..... 426/110
4,774,504 A 9/1988 Hartings
5,042,712 A * 8/1991 DeRoseau ..... 229/401
5,353,011 A * 10/1994 Wheeler et al. ..... 340/572.4
5,406,262 A * 4/1995 Herman et al. ..... 340/572.2
5,428,346 A 6/1995 Franklin
5,597,653 A 1/1997 Ikeda et al.
5,729,202 A * 3/1998 Klaehn ..... 340/572.4
5,771,005 A * 6/1998 Goodwin, III ..... 340/5.91
5,790,029 A 8/1998 Curnutte et al.
5,898,383 A * 4/1999 Forsythe ..... 340/5.91
6,067,015 A * 5/2000 Lian et al. ..... 340/572.1
6,278,371 B1 8/2001 Hopkins
7,093,711 B2 8/2006 Draghetti
7,152,040 B1 * 12/2006 Hawthorne et al. ..... 705/16
7,213,767 B2 * 5/2007 Tethrake et al. ..... 235/492

(Continued)

FOREIGN PATENT DOCUMENTS

DE 3126118 A1 * 1/1983

(Continued)

OTHER PUBLICATIONS

European Search Report for corresponding European Application No. EP 07 25 0094 completed Oct. 17, 2007.

(Continued)

*Primary Examiner*—Tai T Nguyen
(74) *Attorney, Agent, or Firm*—Alston & Bird LLP

(57) ABSTRACT

A scooping device with an integrated electromagnetic (EM) surveillance device for a container. The container defines an interior for storing a product. The scooping device is configured for scooping or capturing the product. The electromagnetic surveillance device is integrated with, embedded into or attach to the body of the scooping device. The electromagnetic surveillance device may be an EAS, Bistatix, RFID, or other electromagnetic surveillance tag or label that is configured to respond to an electromagnetic signal such that the presence of the electromagnetic surveillance device is detectable. The detectability of the electromagnetic surveillance device provides an anti-theft feature to the container without interfering with the construction of the container.

19 Claims, 4 Drawing Sheets

U.S. PATENT DOCUMENTS

| | | | | |
|---|---|---|---|---|
| 7,247,214 | B2 * | 7/2007 | Chamandy et al. | 156/249 |
| 2003/0151512 | A1 | 8/2003 | Loop et al. | |
| 2004/0070504 | A1 | 4/2004 | Brollier et al. | |
| 2004/0135692 | A1 | 7/2004 | Below et al. | |
| 2006/0065670 | A1 | 3/2006 | Doublet et al. | |

FOREIGN PATENT DOCUMENTS

| | | | |
|---|---|---|---|
| DE | 3920044 | A1 * | 6/1988 |
| WO | WO 01/56901 | | 8/2001 |

OTHER PUBLICATIONS

Mikell Knights, Senior Editor; *In-Mold Labeling Catching on in North America*; PTonline.com; Plastics Technology http://www.plasticstechnology.com/articles visited Jun. 20, 2005.

Scott E. Shelton, *In-Mold Labeling*; PTonline.com; Plastics Technology http://www.plasticstechnology.com/articles visited Jun. 20, 2005.

* cited by examiner

SCOOPING DEVICE FOR CONTAINER HAVING AN ELECTROMAGNETIC SURVEILLANCE DEVICE

BACKGROUND OF THE INVENTION

The present invention relates to composite containers, and more particularly relates to composite containers that incorporate an electronic article surveillance (EAS) or radio frequency identification (RFID) device. These EAS and RFID devices, and other devices operating on similar principles, are generically referred to herein as electromagnetic (EM) surveillance devices.

It is becoming increasingly common for the operators of retail establishments to attach EM surveillance devices to products to deter and detect shoplifting. A number of different types of EAS tags and detector systems have been developed and are in use. Generally, all EAS systems include a detection zone formed by a transmitter and a receiver. The transmitter and receiver are positioned at the exit of the retail establishment such that consumers must pass through the detection zone in order to exit the establishment. The transmitter sends a magnetic or radio frequency signal (which are generically referred to herein as electromagnetic signals) at one or more predetermined frequencies to the receiver. When an active EAS tag enters the detection zone, the tag responds and creates a change or disturbance in the received signal, which is detected by the receiver.

One commonly used type of EAS system is the acousto-magnetic system, which utilizes a tag having a magnetostrictive metal strip that changes length in response to a changing magnetic field, and a bias magnet that biases the magnetic field so that it is never zero. The magnetostrictive metal strip is driven at its predetermined resonant frequency by a radio frequency signal generated by the transmitter at the resonant frequency (typically about 58 kHz), and in response to this driving magnetic field, the strip resonates at that frequency. The transmitter sends the RF signal in pulses, and the tag continues to resonate for a short time after the end of each pulse. The receiver detects the signals emitted by the tag in response to the RF pulses. A microcomputer in the receiver checks the tag signals to ensure they are at the correct frequency, are time-synchronized to the pulses, are at the proper level, and are at the correct repetition rate. If all these criteria are met, an alarm is sounded to alert store personnel that an article bearing a still-active EAS tag has passed in close proximity to the transmitter and receiver. The tag can be deactivated by demagnetizing the bias magnet incorporated into the tag.

Another type of EAS system is the electromagnetic system, which employs an adhesive label incorporating a wire or ribbon of metal that has a high magnetic permeability in proximity to a piece of semi-hard magnetic material. The transmitter emits a low-frequency (typically less than 1 kHz) electromagnetic field that causes the metal ribbon to become magnetically saturated twice each cycle, and the metal ribbon emits an electromagnetic signal as a result. Saturation occurs abruptly and causes distinctive patterns in the signal emitted by the label, which are detected by the receiver. The label can be deactivated by magnetizing the semi-hard magnetic material, which saturates the metal ribbon and puts it in an inactive state. The label can also be reactivated by magnetizing the semi-hard magnetic material.

The tags used in EAS systems as described above generally are not "smart" in the sense that the tags do not store information; the tags simply emit a characteristic electromagnetic signal in response to a specific driving electromagnetic field so that the presence of the tags in the detection zone can be detected. In contrast, radio frequency identification (RFID) systems employ "smart" tags that can store information and that can be remotely "read" by a reader to extract that information. Radio frequency identification systems can be used for the tracking of items through manufacturing, in inventory, in shipment, and the like. Generally, an RFID device comprises a tag that includes an integrated circuit (IC) chip microprocessor and a resonant circuit formed by a coiled antenna and a capacitor. In a passive RFID system, a reader generates a magnetic field at a predetermined frequency. When an RFID device, which usually can be categorized as being either read-only or read/write, enters the magnetic field, a small electric current forms in the device's resonant circuit. This circuit provides power to the device, which then modulates the magnetic field in order to transmit information that is pre-programmed on the device back to the reader at a predetermined frequency, such as 125 kHZ (low frequency) or 13.56 MHz (high frequency). The reader then receives, demodulates, and decodes the signal transmission, and then sends the data on to a host computer associated with the system for further processing.

An active RFID system operates in much the same way, but in an active system the RFID device includes its own battery, allowing the device to transmit data and information at the touch of a button. For example, a remote control garage door opener typically uses an active RFID device that transmits a predetermined code to the receiver in order to raise and lower the garage door at the user's discretion.

Another technology that is related to RFID is known as Bistatix, which operates much the same way as RFID devices except that the coiled antenna and capacitor of the RFID device are replaced by a printed, carbon-based material. As a result, a Bistatix device is extremely flat and relatively flexible, although currently these types of devices are limited to a frequency range of about 125 KHz. In addition, the read range of a Bistatix device is dependent on size, and for long read ranges a very large device may be required.

In the present application, the term "EM surveillance device" is used to encompass all of the above-described technologies.

Because the detection zone is actually detecting the EM surveillance device and not the good itself, the EAS system can be circumvented by removing the EM surveillance device from the good. Therefore, it is important to attach the EM surveillance devices to the goods in a manner that prevents their unauthorized removal. Some known EM surveillance devices are configured to have a closed locked position in which the EM surveillance device can not be removed without specialized equipment. These EM surveillance devices are commonly found on clothing merchandise. Other known EM surveillance devices are relatively small and thin with an adhesive backing. These EM surveillance devices are affixed to a surface of the good or product, preferably in an area that masked its presence.

Certain goods have proven challenging in terms of EM surveillance device placement. For example, goods packaged within a composite container traditionally have been difficult for effectively placing the EM surveillance device onto. Although composite containers often store inexpensive goods that typically would not be a high theft item, some relatively high cost goods, such as powdered baby formula, are stored in composite containers making these containers a high theft item and would greatly benefit from the use of an EM surveillance device. Placing an adhesive-backed device on the outside of the container is problematic because the device would be easily seen and removed. Placing the EM surveillance device into the container wall is disclosed in U.S. patent application Ser. No. 11/048,829 assigned to the same assignee as the present application, the entire contents of which are hereby incorporated by reference. However incorporating the EM surveillance device into the wall requires a capital intensive process for precision placement of the device and prevention of interference between the device and other operations of the manufacturing process. Placing the electromagnetic surveillance device between the wall and a print layer closer to the end of the process may reduce the need for precision placement. But it would decrease the aesthetics of the container by causing a bulge from the device, increase the likelihood of unauthorized removal of the device, and likely interfere with the typical convoluted print labeling process for such containers.

Furthermore, until more recently placing an EM surveillance device within the container was problematic due to the foil-based liners used within the container wall. The interference from the foil-based liners would make communication via electromagnetic signals problematic. However, composite containers without a foil layer are becoming more available, making it more practical to place EM surveillance devices within these containers. Even without the foil-based liners, placing an EM surveillance device within the container is not problem-free. For example, the inclusion of a loose EM surveillance device alone would be perceived as an undesirable foreign article or containment.

In light of the foregoing, it would be advantageous to provide a container for storing goods where the container include an EM surveillance device. In particular, it would be advantageous if the placement of the electromagnetic surveillance device is cost effective and hard to detect.

BRIEF SUMMARY OF THE INVENTION

The present invention addresses the above needs and achieves other advantages by providing a scooping device with an integrated EM surveillance device for a container. The container defines an interior for storing a product. The scooping device is for removing the product from the container. The electromagnetic surveillance device is configured to respond to an electromagnetic (EM) signal such that the electromagnetic surveillance device is detectable as part of an anti-theft system and is attached to the scooping device.

According to one aspect of the present invention, the scooping device includes a body and the electromagnetic surveillance device. The body forms a handle portion and a main receptacle portion for scooping the product from the container. The electromagnetic surveillance device is attached to the body. The device may be attached to the body in a variety of manners, including, but not limited to, embedding the device into the body, adhering the device to the body with an adhesive, or holding the device in a cavity formed in the body. The electromagnetic surveillance device may be an EAS, Bistatix, RFID, or other electromagnetic surveillance tag or label that is configured to respond to an electromagnetic signal such that the presence of the electromagnetic surveillance device is detectable.

The container includes the scooping device with the electromagnetic surveillance device for inclusion in the container along with the product. In one embodiment the container further includes a container body having an upper edge and a removable closure affixed to that upper edge. More specifically, according to this embodiment, the container body has a bottom wall and a side wall extending upwardly from the bottom wall and terminating at the upper edge. However, the container may vary. For example, in an alterative embodiment, the container includes a tubular side wall and a bottom closure. The tubular side wall defines a bottom opening, a top opening, and an interior for storing the product and the bottom closure seals the bottom opening.

The present invention further includes a method of packaging a product into a container having an anti-theft feature. The method includes providing the container, attaching the electromagnetic surveillance device to a plastic insert, filling the interior of the container with a predetermined amount of product, and placing the plastic insert with the electromagnetic surveillance device after or concurrently with the filling of the product, and then sealing the opening with a removable closure. In one embodiment the plastic insert is configured as the scooping device.

The present invention has several advantages. Integrating the EM surveillance device into the scooping device masks the presence of the surveillance device or at least makes it less visible or objectionable to the consumer. Furthermore, the placement of the EM surveillance device inside the container makes it difficult to circumvent the anti-theft system by unauthorized removal or deactivation of the surveillance device. Also, the process of preparing and packaging the container is cost effective and allows for the placement of the EM surveillance device to occur near the end of the process to avoid interference from other steps in the manufacturing process.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 2:
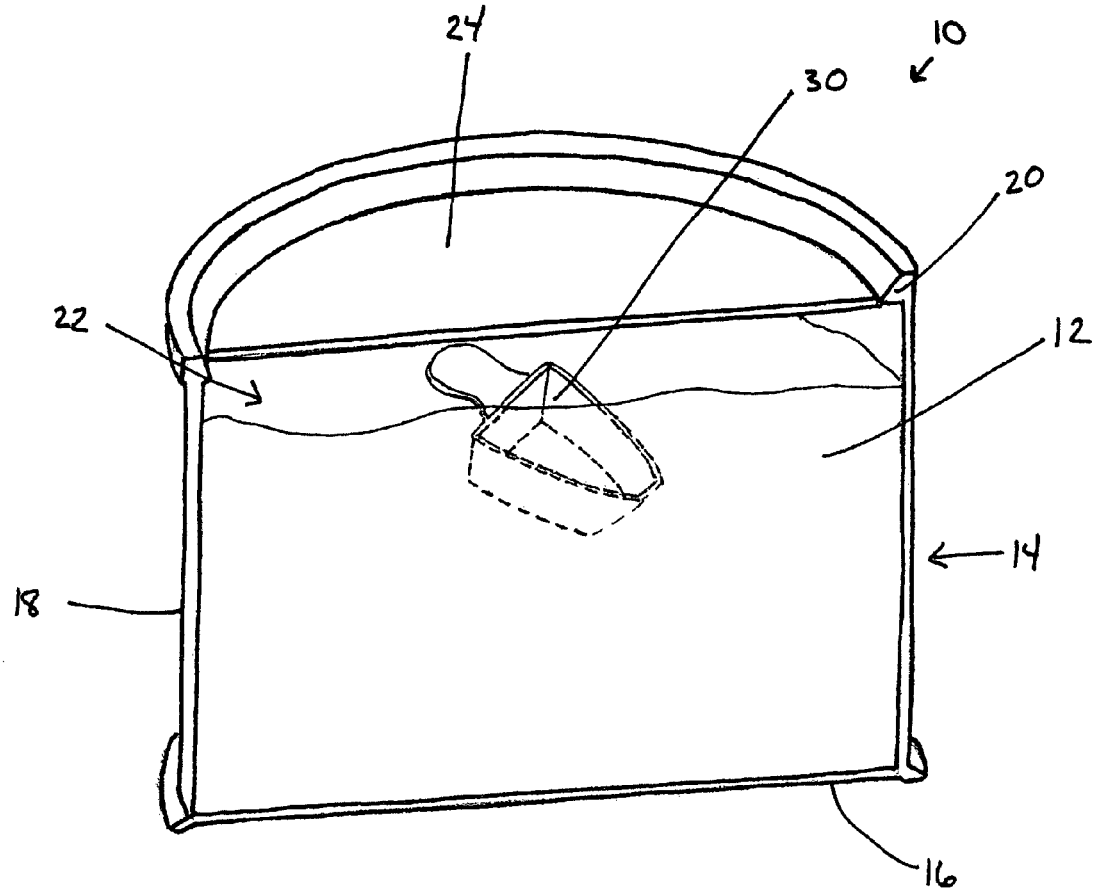
FIG. 2 is a view of the container shown in FIG. 1 taken along line 2-2 illustrating a scooping device within the interior of the container along with the stored product.
Figure 3B:
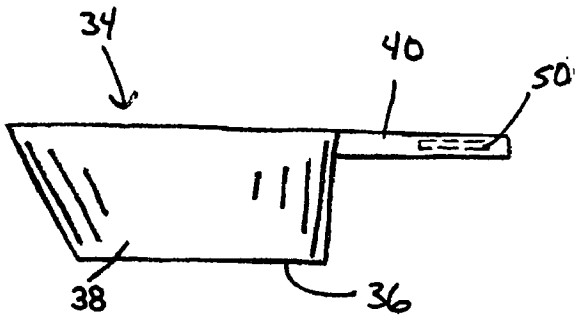
Figure 3A:
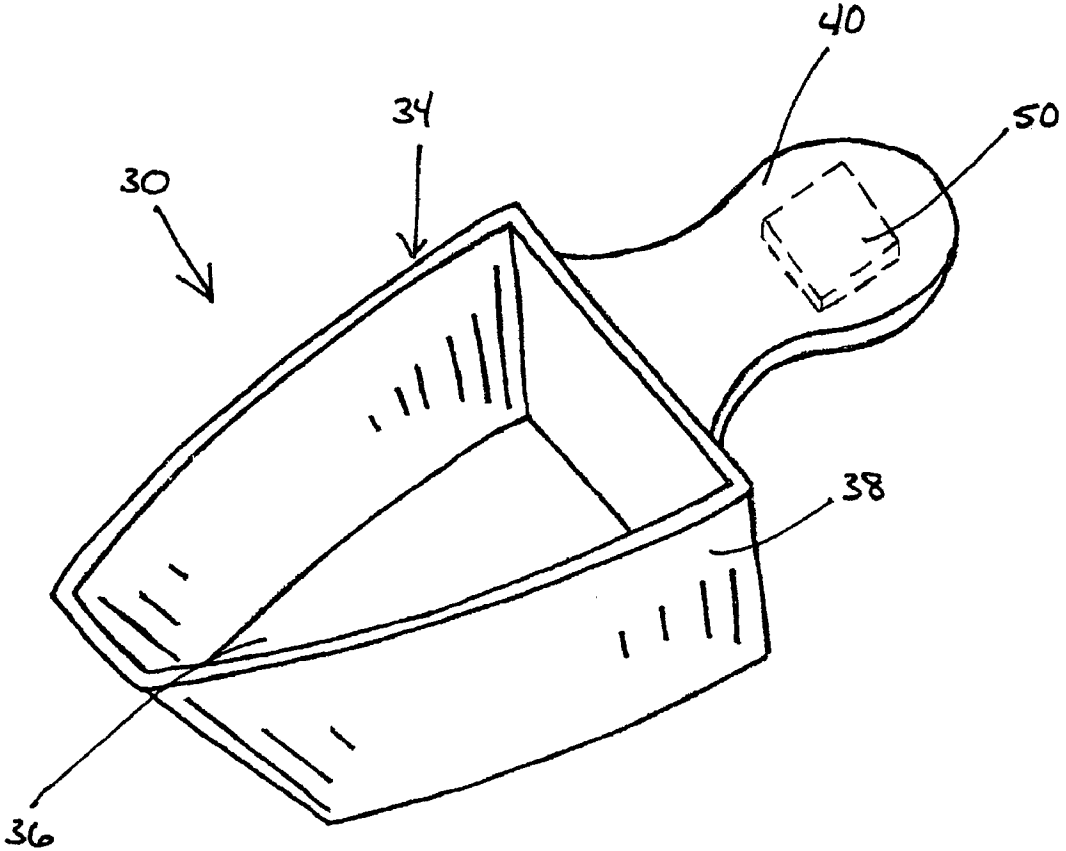

FIG. 3*a* is a perspective view of the scooping device shown in FIG. 2, wherein electromagnetic surveillance device is embedded into the handle portion;

FIG. 3*b* is a side view of the scooping device shown in FIG. 3*a;*

Figures 4A, 4B:
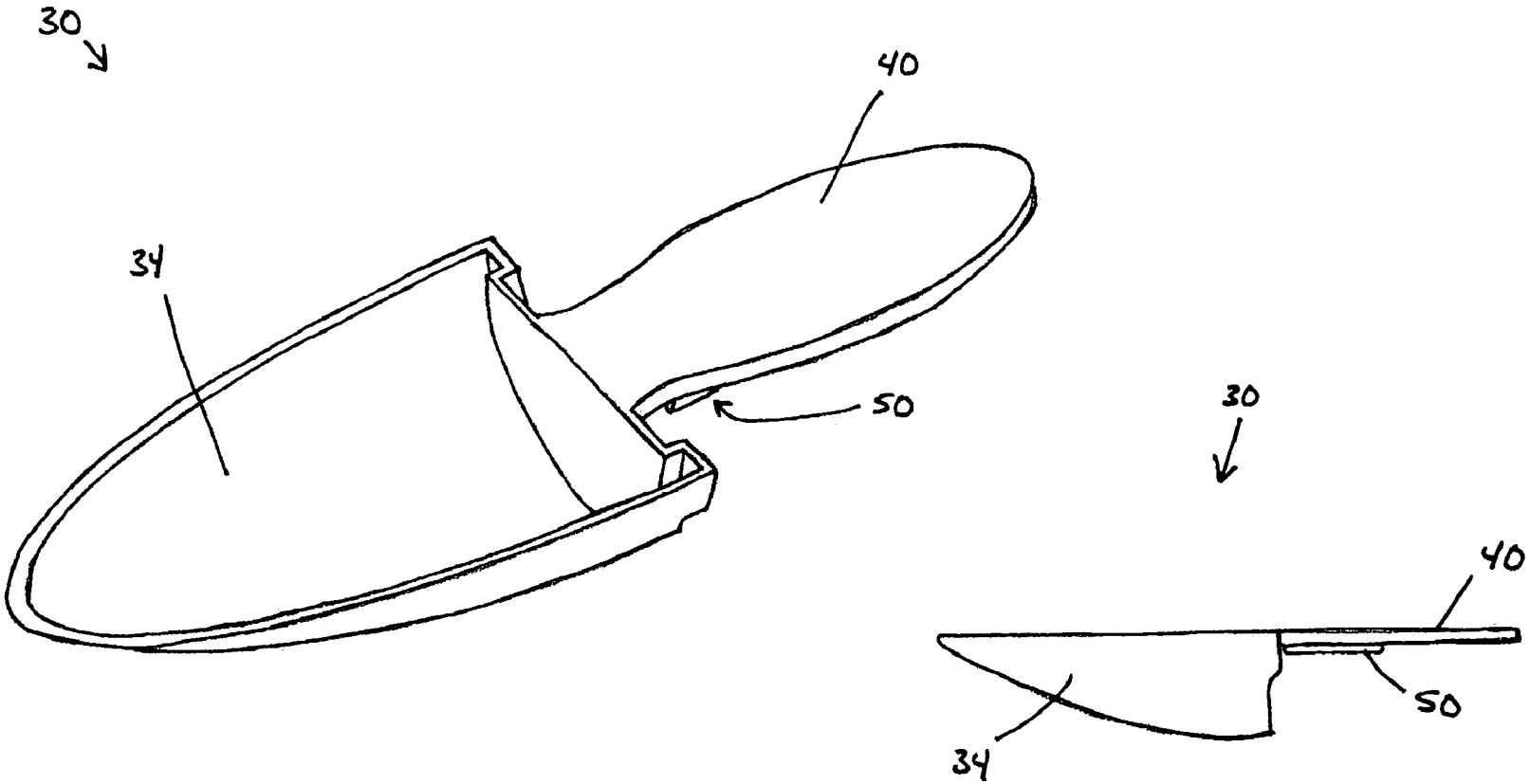

FIG. 4*a* is a perspective view of a scooping device according to another embodiment of the present invention, wherein the electromagnetic surveillance device is adhered to the handle portion; and FIG. 4*b* is a side view of the scooping device shown in FIG. 4*a.*

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Figure 1:
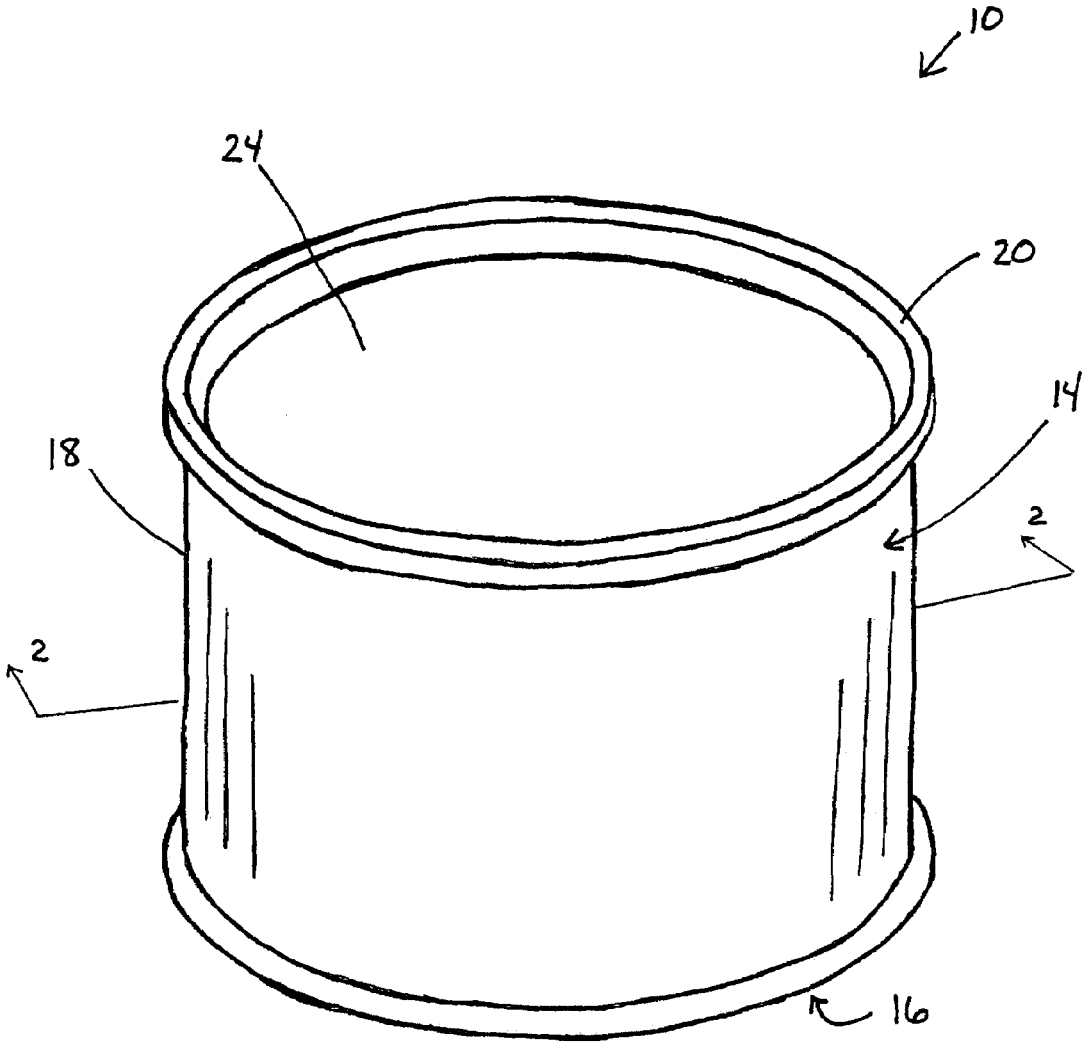
FIG. 1 is a perspective view of a container for storing product according to an embodiment of the present invention.

In general, the present invention provides a scooping device 30 with an integrated electromagnetic (EM) surveillance device 50 for a container 10. FIGS. 1 and 2 show a container 10 according to one embodiment of the present invention. The container 10 is configured to store product or products 12, for example dry baby formula. In particular, the container 10 includes a container body 14 having one or more walls or closures. For example and as illustrated, the container 10 has a tubular side wall 18 defining an interior 22 with a bottom opening and a top opening. A bottom wall, end or closure 16 seals the bottom opening. The side wall 18 extends from the bottom wall 16 to an upper edge 20, which defines the top opening. The container 10 may also include a removable closure 24 affixed to the upper edge 20 in order to close the top opening. The container 10 may be formed by spirally winding one or more plies together.

One consideration that must be taken into account because of the use of the EM surveillance device 50 is that the presence of metal in the vicinity of the surveillance device 50 may interfere with the proper operation of the surveillance device 50. Therefore, although the container body 32 may be formed from a variety of materials including synthetic or biological polymers, the use of foil-based or other metallic layers should be limited. For example, according to the container 10 of FIGS. 1 and 2, the sidewall 18 excludes any foil-based or other metallic layers. However, it has be found that employing foil or metallic layers as part of the bottom end 16 and/or top closure 24 is acceptable, provided that the EM surveillance device 50 is positioned some distance, typically ⅜", from the foil or metal.

Although illustrated as a tubular structure, the overall shape of the container 10 may vary. For example, the container 10 may be generally rectangular in shape. Furthermore, instead of relying on a separate top closure 24 to seal the top opening, the side wall 18 of the container 10 may be configured to fold onto itself to close the opening, similar to a conventional milk carton.

One aspect of the present invention is the scooping device 30. As seen in FIGS. 2-4*b*, the scooping device 30 includes a body 32 and the EM surveillance device 50. In general, the body 32 forms a main receptacle portion 34 configured for scooping or capturing the product 12 from the interior 22. According to one embodiment and as shown in FIGS. 2-3*b*, the main receptacle portion 34 includes a bottom surface 36 and a side surface 38 upstanding or extending from at least a portion of the outer periphery of the bottom surface 38 and forming a general basket structure. However the main receptacle portion 34 may vary. For example, FIGS. 4*a*-4*b* illustrates another embodiment where the main receptacle portion 34 forms a general shovel structure with a more tapered front end. The main receptacle portion 34 may also be configured to measure an amount of product 12 by having a measurement line or other indicia to indicate the amount.

The body 32 may also form a handle portion 40 for grasping and controlling the scooping device 30 by a consumer or operator. The handle portion 40 may be a flange around the main receptacle portion 34 or an elongated member as illustrated in the figures.

Attached to the body 32 is the EM surveillance device 50. The EM surveillance device 50 may be an EAS, Bistatix, RFID, or other EM tag or label that is configured to respond to an electromagnetic signal such that the presence of the electromagnetic surveillance device 50 is detectable. Preferably the EM surveillance device 50 is attached in a manner which masks the presence of the surveillance device 50 from the consumer or a potential shop lifter. For example and as shown in FIGS. 3*a*-3*b*, the EM surveillance device 50 may be embedded into the handle portion 40 such that it is not visible. Embedding the EM surveillance device 50 may be accomplished by molding the EM surveillance device 50 into the body 32 during construction of the scooping device 30. Alternatively, a cavity 42 may be formed into the body 32 during construction of the scooping device 30 and afterward the EM surveillance device 50 may be placed into the cavity and held in place by a stop or an adhesive. In yet another embodiment, the EM surveillance device 50 may be adhered to the scooping device 30 by an adhesive, preferably in an area less visible, such as underneath the handle portion 40 as shown in FIG. 4*a*-4*b*.

A main consideration of the placement of the EM surveillance device 50 within or to the scooping device 30 is to mask the presence of the surveillance device 50 to the consumer in order to minimize the objectionability of placing the surveillance device 50 in the container 10 and to enhance the anti-theft feature of the container 10. Other considerations include the location of the scooping device 30 within the interior 22 of the container 10. As mentioned above, the EM surveillance device 50 should not be near metal. Therefore, in an embodiment having metal ends or closures, the EM surveillance device 50 preferably should be in the portion furthest from either end 16, 24. Typically, the furthest portion is the main receptacle portion 34 because it is more convenient for the consumer to have the handle portion 40 near the top opening.

Another aspect of the invention is a method of packaging the product 12 into the container 10 with the anti-theft feature. The method includes providing the container 10, filling the container 10 with the product 12, and either after filling the container 10 or at the same time as filling the container 10, placing a plastic insert with the attached EM surveillance device 50 into the container 10.

According to one preferred embodiment, the plastic insert is configured as the scooping device 30. However, the plastic insert is not limited to a scooping device 50. One of the aspects of the present invention is placing the EM surveillance device 50 into the container 10 such that it is unnoticeable, or at least unobjectionable to the consumer. Preferably this is accomplished by integrating the surveillance device 50 into the scooping device 30 because the consumers are accustomed to having the scooping device 50 in the container 10. However, depending on the product 12 and container 10, other items are standard and could be used to mask the surveillance device 50. For example, promotional items, such as plastic toys, could be used.

The present invention has several advantages. As mentioned above, integrating the EM surveillance device 50 into the scooping device 30 masks the presence of the surveillance device 50 or at least makes it less visible or objectionable to the consumer. Furthermore, the placement of the EM surveillance device 50 inside the container 10 makes it difficult to circumvent the anti-theft system by unauthorized removal or deactivation of the surveillance device 50. Also, the process of preparing and packaging the container 10 is cost effective and allows for the placement of the EM surveillance device 50 to occur near the end of the process to avoid interference from other steps in the manufacturing process.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A scooping device for a container configured to store a product, said scooping device comprising:

a body forming a handle portion and a main receptacle portion for scooping the product from the container; and an electromagnetic surveillance device being configured to respond to an electromagnetic signal such that the presence of said electromagnetic surveillance device is detectable, said electromagnetic surveillance device being attached to said body.

2. The scooping device according to claim 1, wherein said electromagnetic surveillance device is substantially embedded into said body.

3. The scooping device according to claim 1, wherein said electromagnetic surveillance device is affixed to said body by an adhesive.

4. The scooping device according to claim 1, wherein said body defines a cavity configured to hold said electromagnetic surveillance device.

5. The scooping device according to claim 1, wherein the main receptacle portion comprises a bottom surface and a side surface upstanding from at least a portion of an outer periphery of the bottom surface.

6. The scooping device according to claim 1, wherein said EM surveillance device is an electronic article surveillance tag.

7. The scooping device according to claim 1, wherein said EM surveillance device is an RFID tag.

8. A container for storing a product, said container comprising:

a container body having a bottom wall and a side wall extending upwardly from the bottom wall and terminating at an upper edge;

a removable closure affixed to the upper edge; and a scooping device for inclusion in the container along with the product, said scooping device having a body and an electromagnetic surveillance device, said body forming at least a main receptacle portion for scooping the product from the container, and said electromagnetic surveillance device being configured to respond to an electromagnetic signal such that the presence of said electromagnetic surveillance device is detectable, said electromagnetic surveillance device being attached to said body.

9. The container according to claim 8, wherein said body further comprises a handle portion.

10. The container according to claim 8, wherein said electromagnetic surveillance device is substantially embedded into said body.

11. The container according to claim 8, wherein said electromagnetic surveillance device is affixed to said body by an adhesive.

12. The container according to claim 8, wherein said body defines a cavity configured to hold said electromagnetic surveillance device.

13. The container according to claim 8, wherein the main receptacle portion comprises a bottom surface, and a side surface upstanding from at least a portion of an outer periphery of the bottom surface.

14. The container according to claim 13, wherein the side surface extends from substantially the entire outer periphery of the bottom surface.

15. A composite container for storing a product, said composite container comprising:

a tubular side wall defining a bottom opening, a top opening and an interior for storing the product;

a bottom closure for sealing the bottom opening; and a scooping device for scooping a predetermined amount of product from the interior;

wherein an electromagnetic surveillance device is substantially embedded within said scooping device, said electromagnetic surveillance device being configured to respond to a RF signal such that the presence of said electromagnetic surveillance device is detectable.

16. The composite container according to claim 15, wherein the electromagnetic surveillance device is an electronic article surveillance tag.

17. The composite container according to claim 15, wherein the electromagnetic surveillance device is a RFID tag.

18. A method of packaging a product into a container having an anti-theft feature, the method comprising:

providing a container having a body defining an interior for storing a product and defining an opening;

attaching an electromagnetic surveillance device to a plastic insert;

filling a predetermined amount of the product into the interior;

after or concurrently with said step of filling a predetermined amount of product, placing the plastic insert into the interior; and sealing the opening with a removable closure.

19. The method according to claim 18, wherein the plastic insert is configured as a scooping device for scooping the product from the interior.

* * * * *

UNITED STATES PATENT AND TRADEMARK OFFICE

CERTIFICATE OF CORRECTION

PATENT NO. : 7,646,302 B2
APPLICATION NO. : 11/332435
DATED : January 12, 2010
INVENTOR(S) : Thomas J. Setty It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 399 days.

Signed and Sealed this

Sixteenth Day of November, 2010

David J. Kappos

David J. Kappos
*Director of the United States Patent and Trademark Office*